US007712597B2

(12) United States Patent
Frost

(10) Patent No.: US 7,712,597 B2
(45) Date of Patent: May 11, 2010

(54) DEVICE FOR SORTING COINS

(75) Inventor: Detlef Frost, Hollenbeck (DE)

(73) Assignee: National Rejectors, Inc. GmbH, Buxtehude (DE)

( * ) Notice: Subject to any disclaimer, the term of this patent is extended or adjusted under 35 U.S.C. 154(b) by 0 days.

(21) Appl. No.: 12/211,573

(22) Filed: Sep. 16, 2008

(65) Prior Publication Data

US 2009/0078531 A1 Mar. 26, 2009

(30) Foreign Application Priority Data

Sep. 20, 2007 (DE) ..... 10 2007 046 391

(51) Int. Cl.
*G07F 1/04* (2006.01)

(52) U.S. Cl. ..... 194/346

(58) Field of Classification Search ..... 194/346
See application file for complete search history.

(56) References Cited

U.S. PATENT DOCUMENTS

| | | | | |
|---|---|---|---|---|
| 4,393,972 | A | 7/1983 | Maloy | |
| 4,495,959 | A * | 1/1985 | Farber | 453/9 |
| 2002/0060121 | A1 * | 5/2002 | Igusa | 194/302 |

FOREIGN PATENT DOCUMENTS

| | | | |
|---|---|---|---|
| DE | 23 31 361 | A | 1/1975 |
| DE | 42 24 029 | A1 | 10/1993 |
| EP | 0 622 763 | B2 | 12/1993 |
| EP | 0 576 436 | B1 | 5/1994 |
| EP | 0 957 457 | B1 | 1/1999 |
| EP | 1 628 266 | A2 | 2/2006 |

* cited by examiner

*Primary Examiner*—Patrick Mackey
*Assistant Examiner*—Mark Beauchaine
(74) *Attorney, Agent, or Firm*—Vidas, Arrett & Steinkraus, P.A.

(57) ABSTRACT

A device for sorting coins in at least four coin tubes of a coin changer that leave a coin testing device, the coin tubes being located in a common plane, the device comprising a housing having a substantially vertical wall, a first gate element including a first runway inclined relative to a horizontal level and a barrier portion at the lower end of a first runway, the first gate element being supported for movement approximately perpendicular to wall and actuable by a first electro magnet between two positions, in the first position the first runway projecting from wall and the first barrier portion together with wall forming a passage whereby a coin may roll along the first runway through the passage while in the second position the runway extends into wall and the first barrier portion is adjacent to wall.

9 Claims, 3 Drawing Sheets

DEVICE FOR SORTING COINS

CROSS-REFERENCE TO RELATED APPLICATIONS

Not applicable

STATEMENT REGARDING FEDERALLY SPONSORED RESEARCH

Not applicable

BACKGROUND OF THE INVENTION

It is generally known to provide money changers for coin-operated machines with so-called coin tubes which receive coins of certain denominational values in an upright position. The coin tubes stack the coins in columns, and a pay-out device associated with the lower ends of the coin tubes delivers coins from the tubes in correspondence to the small change which is to be given out. Prior to this, a coin testing device tests the coins for genuineness. Coins which are found to be genuine either get into a cash-box or sorting device which sorts the coins into the individual tubes according to their denominational values. More recent money changers have a maximum of six coin tubes for coin storage.

From EP 0 957 457 B1, the entire contents of which is incorporated herein by reference, a sorting device for coin-operated machines has become known in which coin tubes arranged in a row are allotted the coins via four sorting flaps. From EP 0 622 763 B2, the entire contents of which is incorporated herein by reference, a sorting device has become known in which sorting gates are provided in three superposed planes to route coins to four coin tubes.

From EP 0 576 436 B1, the entire contents of which is incorporated herein by reference, a sorting device has become known which also feeds four coin tubes. A first V-shaped gate element leads incoming coins to one side or the opposite one. For this purpose, the two legs of the V-shaped gate element are either in the plane of the arriving coins or outside the same. The first gate element is operated by a first solenoid. Either side of the first gate element has disposed thereon gate portions which can be pivoted about a vertical axis. When in one position, they pass arriving coins on to another runway and, when in the other position, they direct the coins to a coin tube which is disposed underneath. Here, the disadvantage is that the coins require to be deflected in a vertical direction from the plane in which they drop into the sorting device.

It is the object of the invention to provide a device for sorting coins in which the coins are moved and deflected in one plane only.

BRIEF SUMMARY OF THE INVENTION

In the inventive device, the axes of the coin tubes are located in a common plane. A first gate element and a second gate element have runways each associated therewith above one of the middle coin tubes. Two runways are oriented towards the outer coin tubes each, the two runways also allow a downward passage to the middle coin tubes when the second gate element is inoperative and the runways are retracted. The coins are routed towards the outer coin tubes when the second gate element is operated.

In the inventive sorting device, the coins will always remain in one plane and will not be deflected, which has a very favourable effect on the wear and the rapidity of forward motion of the coins.

In an aspect of the invention, the second gate element has coupled thereto barrier portions which extend into the common plane when the second gate element is inoperative, and are retracted from the plane when the second gate element is operated. The barrier portions take care that the coins are able to enter the coin tube, which is located underneath, in a substantially vertical position when the second gate element is inoperative.

Another aspect of the invention provides that the first gate element has a first runway which is oriented towards a fourth runway located in the dropping path of the coins with the first runway extending into the common plane when the first gate element is inoperative and being retracted from the plane when the first gate element is operated. Coins which arrive from the coin tester, after passing the reception gate, drop onto the fourth runway of a so-called cash-box gate. If the cash-box gate is not being operated all coins will drop into the cash-box disposed underneath. On the other hand, if the cash-box gate is being operated the coins arriving from the coin tester drop onto the fourth runway and are deflected to the first runway.

In another aspect of the invention, the first gate element, at the end of the third runway, has a first barrier portion which has a passage for the coins when the first gate element is not being operated, and directs arriving coins towards the second or third runway of the second gate element when the first gate element is being operated. The passage which is defined by the second and first runways or the first barrier portion is limited by the wall of the sorting device in which the first and second gate elements are slidably mounted.

According to a further aspect of the invention, it is advantageous for the sorting procedure if the outer coin tubes have their upper ends disposed lower than the middle coin tubes.

To achieve a larger storage capacity or allow the coin tubes to accommodate coins of more denominational values an aspect of the invention provides that a fifth and a sixth coin tube be provided the axes of which are located approximately in a joint second and third plane with the axes of the matching outer coin tubes, the first and second planes being nearly perpendicular to the first plane. Above the outer coin tubes, further gate elements each can be operated by a solenoid provided and allow the coins to pass to the outer coin tubes when the third or fourth gate element is not being operated, and directs the coins to the fifth or sixth coin tube when the third or fourth gate element is being operated.

The second gate element preferably constitutes a unit with the second and third barrier portions. According to an aspect of the invention, arms for the barrier portions and the barrier portions can define a first component and the runways of the second gate element can define a second component, which are combined into a unit. Since those components preferably are formed from a plastic it is advantageous to provide one component with a latch pin and the other one with a detent aperture which are of a non-releasable snap-in configuration.

An embodiment of the invention will be described in more detail below with reference to the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
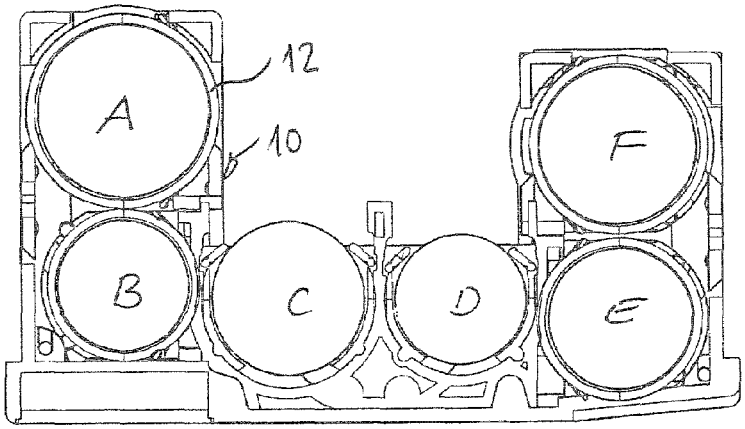
FIG. 1 shows a plan view of a tube cassette for a sorting device of the invention.

FIG. 1 illustrates a plan view of a coin tube cassette 10 where the individual coin tubes 12 are designated A, B, C, D, E, and F. The axes of coin tubes B to E are located approximately in a common first plane. The axes of coin tubes A and B and F and E are also located approximately in a common second and third plane each. The two planes mentioned last are approximately perpendicular to the first plane.

Figure 2:
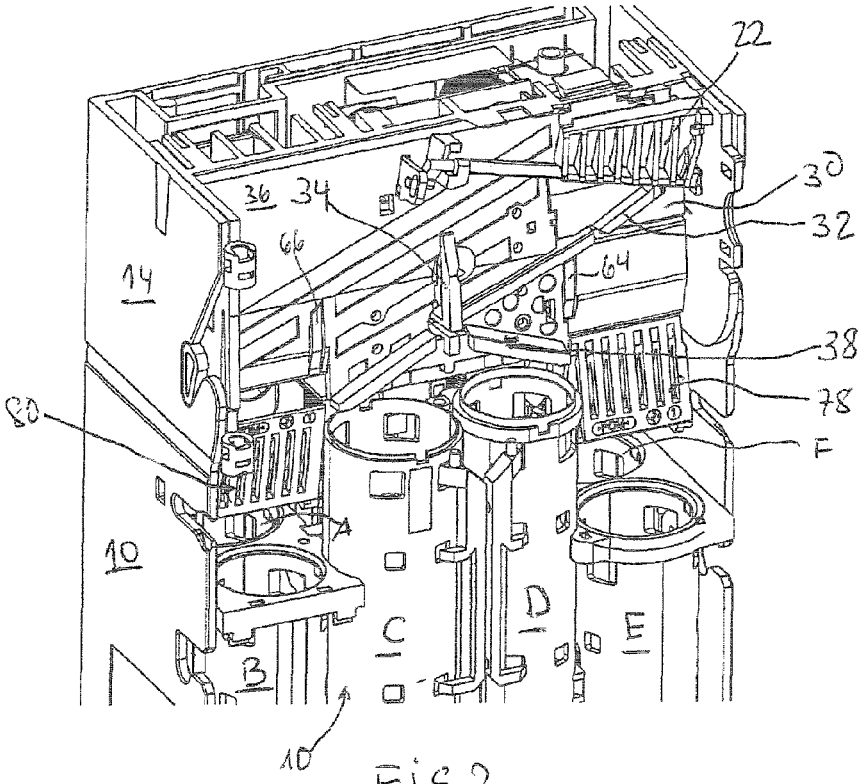
FIG. 2 shows the upper portion of the tube cassette of FIG. 1 with the sorting device of the invention in a perspective view.

From FIG. 2, it can be seen that the upper ends of inner coin tubes C and D are located higher than the upper ends of the outer coin tubes B and E and coin tubes A and F each. The tube cassette 10 is placed in an apparatus casing which is not shown and, as illustrated in FIG. 2, also houses the assembly units of the sorting device and coin tester that are described below.

The sorting device comprises two superposed sorting modules here in a casing (14).

Figure 3:
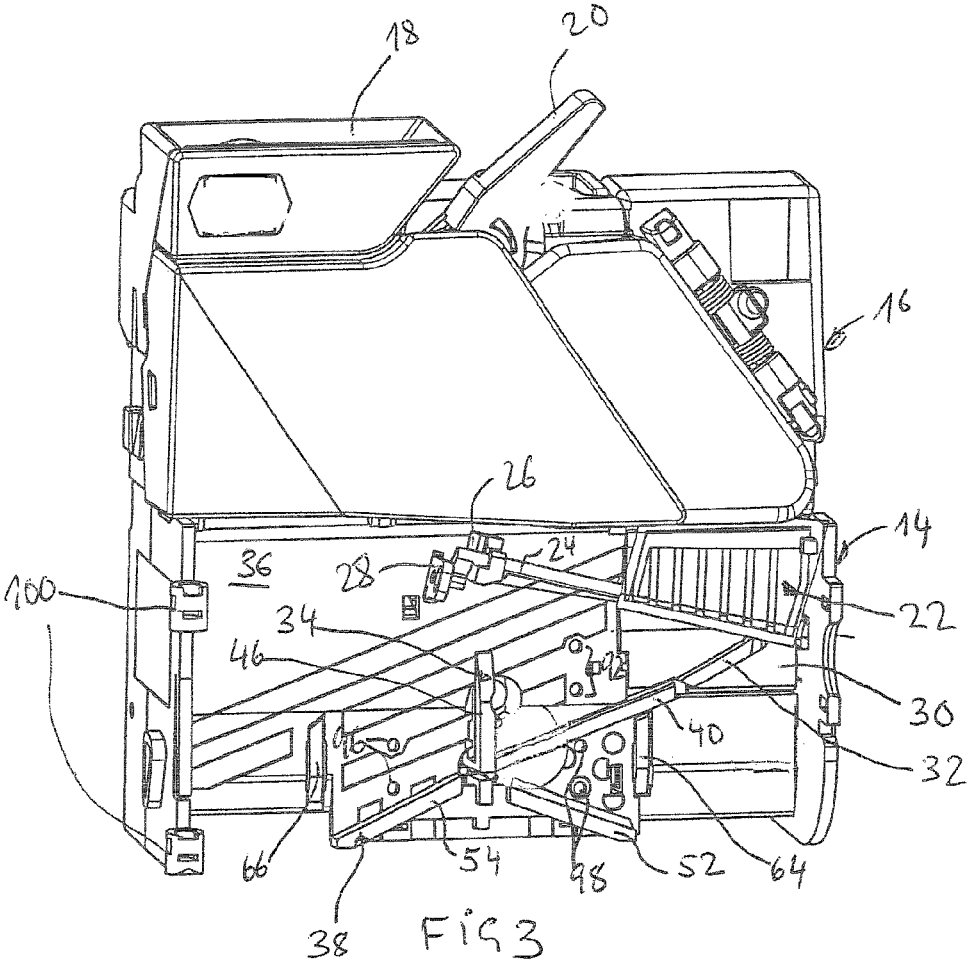
FIG. 3 shows the sorting device of FIG. 2 with a coin tester disposed there above in a perspective view.
Figure 4:
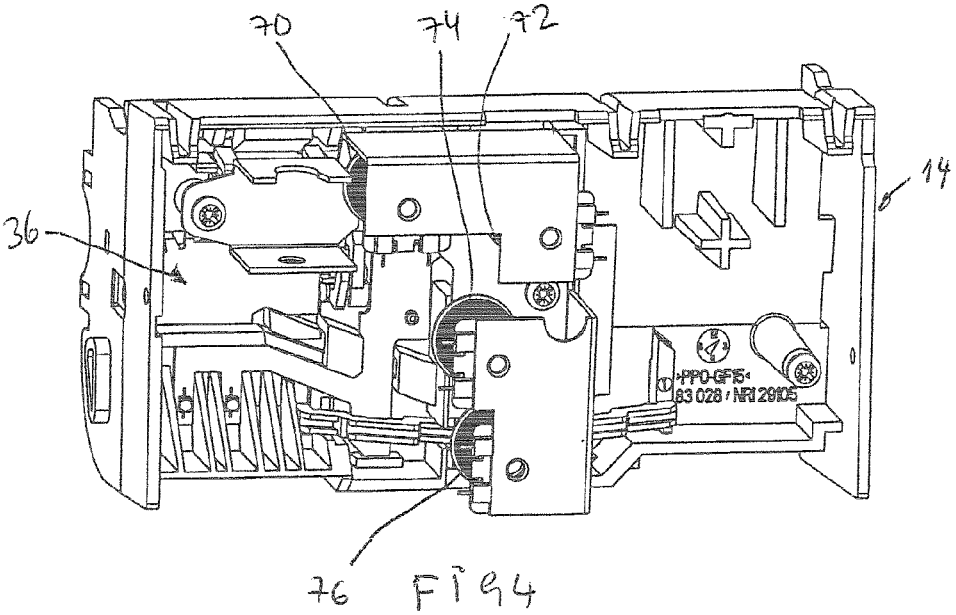
FIG. 4 shows the back of the sorting device of FIG. 3 in a perspective view.

The upper sorting module shown in FIG. 4 is joined together with the coin testing module as is shown in FIG. 3 and can be inserted as a unit into the apparatus casing.

Figure 5:
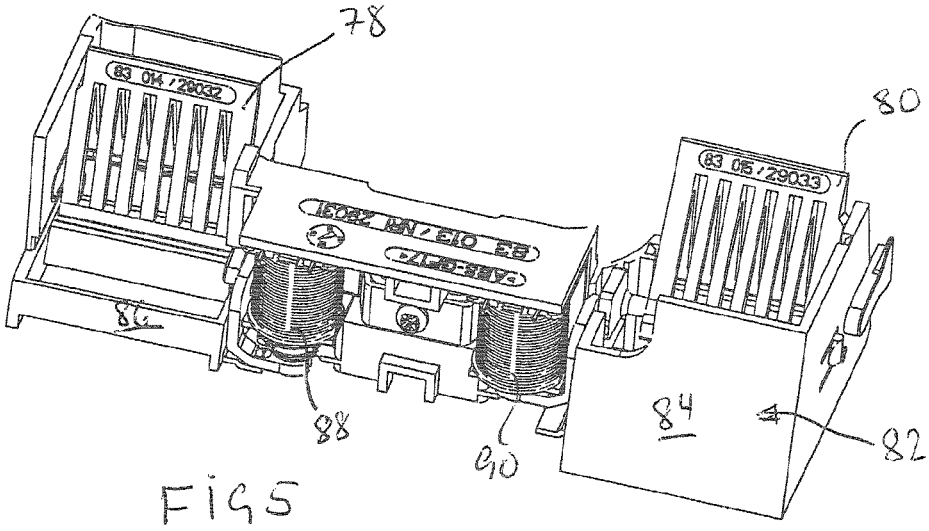
FIG. 5 shows another portion of the sorting device for the outer coin tubes of FIGS. 1 and 2 in a perspective view.

The second sorting module shown in FIG. 5 is inserted directly below in the apparatus casing in the portion as is depicted in FIG. 2. When so inserted, it is guided by a slot in the casing and is snapped into place in the end position.

FIG. 3 shows the way a casing portion 16 of a coin tester is placed on top of the casing 14. The casing 16 has an insertion hopper 18 and a return lever 20. The construction of the coin tester in the casing 16 is conventional and will not be described in more detail. A coin gate 22 is pivotally supported about an approximately horizontal axis in the casing portion 14 of the sorting device. The coin gate 22 has mounted thereon an actuation shaft 24 which is pivotally supported at 26 and is pivoted by a portion 28 which is operated by a solenoid not recognizable in FIG. 3. Below the acceptance gate 22, there is a cash-box gate 30 which is also actuated by a solenoid which is not shown. The cash-box gate has a runway portion 32.

Figure 6:
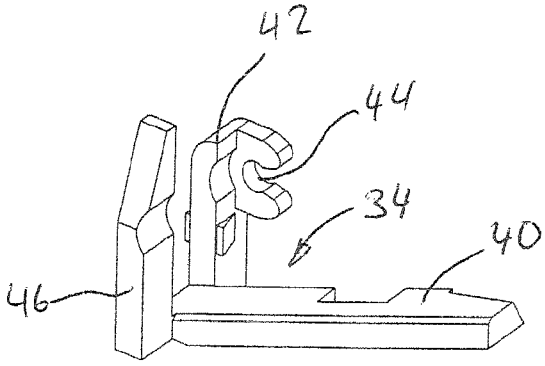
FIG. 6 shows a first gate element of the sorting device of the invention in a perspective view.
Figure 7:
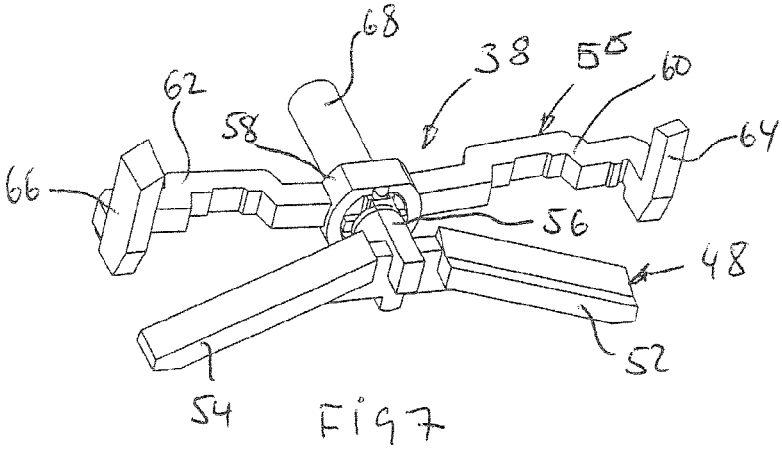
FIG. 7 shows a second gate element of the sorting device of the invention in a perspective view.

A first gate element 34 is slidably supported perpendicularly to the plane of the drawing in a wall 36 of the casing 14. A second gate element 38 also is slidably supported perpendicularly to the plane of the drawing in the wall 36. The gate elements 36, 38 are illustrated in FIGS. 6 and 7.

The gate element 34 has a runway portion 40 and a first upwardly extending arm 42 with a recess 44. Another arm 44 parallel thereto on the opposite side of the runway portion 40 defines a barrier portion. A pin-type anchor (not shown), which forms part of a solenoid for operating the first gate element 34, is snapped into the recess 44.

The second gate element 38 has a first component 48 and a second component 50 which are combined together into a unit. The first component has two runway portions 52, 54 each, which are slantingly oriented downwards, on opposed sides. In the middle, they are joined to a pin-like trunnion 56 which extends obliquely to the plane in which the runway portions 52, 54 are arranged.

The second component 50 has a bushing-shaped middle portion 58 into which the trunnion 56 may non-releasably be snapped. However, the connection described is not rigid, but allows of a certain pivoting motion of the two components 48, 50 relative to each other. Arms 60, 62 at the ends of which a barrier portion 64 and 66 each is mounted extend on opposite sides of the bushing 58. The bushing 58 further has joined thereto a metallic pin 68 which leads to a solenoid for actuating the second gate element 37.

FIG. 4 shows the other side of the casing 14. Two upper solenoids 70, 22 can be recognized. The solenoid 70 operates the cash-box gate 30 and the solenoid 72 operates the acceptance gate 22. The operating portion 28 of FIG. 3 thus belongs to the solenoid 72. However, the operation mechanism will not be described in detail since it is conventional.

FIG. 4 allows recognizing a further solenoid 74 which serves for operating the first gate element 34. A further solenoid 74 serves for operating the second gate element 38.

In FIG. 3, the first and second gate elements 34, 38 are in an inoperative position of the solenoids 74, 76. When the cash-box gate 30 is operated this causes genuine coins which are passed by the acceptance gate 22 to get onto the runway 32 of the cash-box gate 30 and, subsequently, onto the runway 40 of the first gate element 34. The coin rolls down the runway 40 and passes the barrier portion because this portion leaves a distance from the wall 36 of the casing 14. As a result, the coin gets into the area of the runway 54. This runway, however, also is at a distance from the wall 36 when the solenoid 76 for the second gate element 38 is inoperative. This implies that the coin drops down in front of the barrier portion 66. The barrier portion 66, which extends from the plane in which the arriving coin is rolling, takes care that the coin is deflected downwards. With regard to FIG. 2, this means that the coin drops into tube C.

An activation of the solenoid 74 causes the first gate element 34 to be operated and the runway 40 to get outside the plane in which coins roll from runway 32 to runway 54, causing the coin to drop down. The barrier portion 34, which now does not present a passage any longer for the coin, takes care that the coin be deflected downwards. Since the runway 52 forms a gap with the wall 36 the coin will drop down vertically, which means in FIG. 2 that the coin drops into the tube D.

If only the second gate element 38 is operated a coin will run along the runway 40 through the barrier portion onto the runway 54 because this one no longer forms a gap with the wall 36. Hence, the coin runs along the runway 54 and, thence, into the tube disposed underneath, which is tube B in FIG. 2.

If the two gate elements 34, 38 are operated by an activation of the two solenoids 74, 76 the coin, when behind the runway 32, gets directly onto the runway 52 because the runway 40 is retracted from the coin plane. Since the runway 52 has ceased to form a gap with the wall 36 the coin will run rightwards into the tube which is disposed underneath and is tube E in FIG. 2.

It can be seen that if the deflections described exist the coin will always remain in the same plane and need not be deflected to any place.

FIG. 2 allows recognizing that further gate elements 78, 80 are laterally disposed below the gate elements 34, 38. When activated, they serve to direct arriving coins into coin tubes A or F, respectively. The gate elements 78, 80 are supported in casing portions 84, 86 of the casing part 82 of the second sorting module and can be pivoted about an axis which approximately is horizontal. Their operation is performed by means of solenoids 88 or 90. The pivoting mechanism is not shown in detail.

It can be seen from FIG. 2 in conjunction with FIG. 5 that if the third or fourth gate element 78, 80 is inoperative the coins arriving from the runway of the second gate element 38 are directed each into tube B or E. On the other hand, if a solenoid 88 or 90 is operated a coin arriving from one of the two runways will be routed to the coin tube A or F.

In FIG. 3, a sorting sensor is arranged at 92 and a further sensor is disposed at 96 or 98. They detect that a coin is passing on the runways 52, 54 or runway 40 and enable the coins to be counted.

As is outlined at 100 the casing 14 has hinged thereto a flap (not shown) which closes the open side of the sorting device. The flap contains prisms, not shown, for the sensors 92, 96, and 98. One of the two small circles pertaining to the sensors shown denotes a pass of a light beam which is reflected in a prism in the flap, not shown, into the other aperture behind which a light-sensitive element is disposed. Sensors of this type are known as such in coin testers and sorting devices.

The flap further includes a return channel towards which the coins are led by the acceptance gate 22 if the coin tester identifies a counterfeit coin. Coins will also get out through the return channel if the return lever 20 of the coin tester is actuated.

A printed-circuit board for operating the solenoids and activating the sensors 92, 96, 98 is located at the back of the casing 14 that is shown in FIG. 4. This printed-circuit board is also connected, via a flat cable, to a printed-circuit board which performs the control of the coin tester which was not described in detail.

What is claimed is:

1. A device for sorting coins in at least four coin tubes of a coin changer that leave a coin testing device, the coin tubes being located in a common plane, the device comprising:

a housing (14) having a substantially vertical wall (36), a first gate element (34) including a first runway (40) inclined relative to a horizontal level and a barrier portion (46) at the lower end of a first runway (40), the first gate element (34) being supported for movement approximately perpendicular to wall (36) and actuable by a first electro magnet (74) between two positions, in the first position the first runway (40) projecting from wall (36) and the first barrier portion (46) together with wall (36) forming a passage whereby a coin may roll along the first runway (40) through the passage while in the second position the runway (40) extends into wall (36) and the first barrier portion (46) is adjacent to wall (36) whereby a coin moving to the area of the first runway (40) is deflected downwardly by the first barrier portion (46), further comprising;

a second gate element (38) having a second and third inclined runway (52, 54) and a second and a third barrier portion (64, 66) associated with the ends of the second and third runway and the second gate element (38) being supported for movement approximately perpendicular to wall (36) and actuable by a second electro magnet (76) into two positions, in the first position the second runway (52) is located below the first runway (40) and the third runway which is located downstream of the first barrier portion (46) forming a space relative to wall (36) and second and third barrier portion (64, 66) being adjacent to wall (36) whereby an approaching coin is deflected downwardly by the second or third barrier portion (64, 66), respectively, while in the second position the second and third barrier portion (64, 66) are retracted into wall (36) and second and third runway (52, 54) being adjacent to wall (36) whereby a coin thereupon can roll towards the free end of the second or third runway (52, 54) respectively and the first and second gate element (34, 38) being designed such that the coins move in a single plane aligned with the plane of the coin tubes (B, C, D, E), characterized in that the first runway (40) of the first gate element (34) is oriented towards a fourth runway (32) which in turn is located in the dropping path of the coins from the coin testing device.

2. The device according to any one of claims 1, characterized in that the outer coin tubes (B, E) have their upper ends disposed lower than the middle coin tubes (C, D).

3. The device according to claim 1, characterized in that a fifth and a sixth coin tube (A, F) are provided the axes of which are located approximately in a joint second or third plane with the axes of the outer coin tubes facing them.

4. The device according to claim 3, characterized in that the first or second plane is nearly perpendicular to the first plane.

5. The device according to claim 3, characterized in that a third or fourth gate element (78, 80) is disposed above the outer coin tubes (B, E) which directs the coins in the first plane towards the outer coin tubes (B and E, respectively) when the third or forth gate element is not operated, and directs the coins towards the fifth or sixth coin tube (A, F), when the third or fourth gate element is operated.

6. The device according to claim 1, characterized in that the barrier portions (64, 66) are joined to the second gate element (38) via arms (60, 62).

7. The device according to claim 1, characterized in that a presence sensor (92, 96, 98) is associated with the first gate element (34) and/or the second or third runway (52, 54) of the second gate element (38).

8. A device for sorting coins in at least four coin tubes of a coin changer that leave a coin testing device, the coin tubes being located in a common plane, the device comprising:

a housing (14) having a substantially vertical wall (36), a first gate element (34) including a first runway (40) inclined relative to a horizontal level and a barrier portion (46) at the lower end of a first runway (40), the first gate element (34) being supported for movement approximately perpendicular to wall (36) and actuable by a first electro magnet (74) between two positions, in the first position the first runway (40) projecting from wall (36) and the first barrier portion (46) together with wall (36) forming a passage whereby a coin may roll along the first runway (40) through the passage while in the second position the runway (40) extends into wall (36) and the first barrier portion (46) is adjacent to wall (36) whereby a coin moving to the area of the first runway (40) is deflected downwardly by the first barrier portion (46), further comprising;

a second gate element (38) having a second and third inclined runway (52, 54) and a second and a third barrier portion (64, 66) associated with the ends of the second and third runway and the second gate element (38) being supported for movement approximately perpendicular to wall (36) and actuable by a second electro magnet (76) into two positions, in the first position the second runway (52) is located below the first runway (40) and the third runway which is located downstream of the first barrier portion (46) forming a space relative to wall (36) and second and third barrier portion (64, 66) being adjacent to wall (36) whereby an approaching coin is deflected downwardly by the second or third barrier portion (64, 66), respectively, while in the second position the second and third barrier portion (64, 66) are retracted into wall (36) and second and third runway (52, 54) being adjacent to wall (36) whereby a coin thereupon can roll towards the free end of the second or third runway (52, 54) respectively and the first and second gate element (34, 38) being designed such that the coins move in a single plane aligned with the plane of the coin tubes (B, C, D, E), characterized in that the first runway (40) of the first gate element (34) is oriented towards a fourth runway (32) which in turn is located in the dropping path of the coins from the coin testing device characterized in that the barrier portions (64, 66) are joined to the second gate element (38) via arms (60, 62), characterized in that the arms (60, 62) and second and third barrier portion (64, 66) define a first component and the second and third runway (52, 54) of the second gate element (38) define a second component which are adapted to be combined into a unit so that they can be pivoted relatively to each other within limits.

9. The device according to claim 8, characterized in that the second component (48) has a latch pin (56), which is configured to be capable of non-releasably being snapped into a detent aperture of the first component (50).

* * * * *